US008109508B2

(12) United States Patent
de Jong et al.

(10) Patent No.: US 8,109,508 B2
(45) Date of Patent: Feb. 7, 2012

(54) METHOD AND SYSTEM FOR DETERMINING IMPROVED CORRECTION PROFILES FOR SHEET REGISTRATION

(75) Inventors: Joannes N. M. de Jong, Hopewell Junction, NY (US); Lloyd A. Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 155 days.

(21) Appl. No.: 11/731,487

(22) Filed: Mar. 30, 2007

(65) Prior Publication Data

US 2008/0237975 A1 Oct. 2, 2008

(51) Int. Cl.
*B65H 7/02* (2006.01)

(52) U.S. Cl. ..... 271/228

(58) Field of Classification Search ..... 271/227, 271/228

See application file for complete search history.

(56) References Cited

U.S. PATENT DOCUMENTS 4,971,304 A 11/1990 Lofthus
5,169,140 A 12/1992 Wenthe, Jr.
5,219,159 A 6/1993 Malachowski et al.
5,278,624 A 1/1994 Kamprath et al.
5,407,191 A * 4/1995 Ukai ..... 271/227
5,678,159 A 10/1997 Williams et al.
5,794,176 A 8/1998 Milillo
6,137,989 A 10/2000 Quesnel
6,168,153 B1 1/2001 Richards et al.
6,533,268 B2 3/2003 Williams et al.
7,593,684 B2 9/2009 De Jong et al.
7,717,533 B2 5/2010 De Jong et al.
2003/0146567 A1 8/2003 Williams et al.
2005/0206072 A1 * 9/2005 Tanabe ..... 271/226

* cited by examiner

*Primary Examiner* — Michael McCullough

(74) *Attorney, Agent, or Firm* — Fay Sharpe LLP

(57) ABSTRACT

A method and system improves sheet registration in a document processing device. A technique is implemented that produces accurate results with merely a small tail wag. To do so, the technique ultimately establishes or determines a variety of parameters (e.g. lateral position of a sheet, skew, registration time, nominal sheet velocity, and correction velocity). These parameters are then used to calculate a lateral velocity profile. In this regard, the calculated velocity profiles are applied to the wheels or nips, in the paper path. Thus, the wheels can be controlled and will allow for improved sheet registration in the document processing device.

20 Claims, 8 Drawing Sheets

METHOD AND SYSTEM FOR DETERMINING IMPROVED CORRECTION PROFILES FOR SHEET REGISTRATION

BACKGROUND

In printing environments, the transport of paper, or other sheets upon which text and images are rendered, is one of many important components in the overall quality of the printed sheet. In this regard, accuracy and precision of registration of the sheets to the text and images printed thereon contribute to the print quality. If the sheets are not transported in an acceptable manner, then the registration process could be adversely impacted.

In high speed, high end printing environments, a technique of agile registration has developed. Agile registration relates to registration techniques that involve high speed, adaptive, closed loop processes.

More particularly, with reference to FIG. 1, a document processing device 10 is illustrated. The device 10 includes a controller 12 that controls a variety of functions of the device including the paper path. In this regard, the paper path includes stationary nips A and B which impart x-direction velocity vectors $V_A$ and $V_B$ on a sheet 14. The average $(V_A+V_B)/2$ provides an x-direction (process direction) motion to the sheet 14. The difference $(V_A-V_B)$ provides a rotation of the sheet 14. The sheet 14 is to be delivered to a device downstream. This device can be a photoreceptor or a drum (where it can receive an image) or any other appropriate device, inclusive of another set of nips.

In known processes, before the sheet 14 enters the nips A and B, the velocities $V_A$ and $V_B$ are typically set equal to the paper velocity of the upstream paper path $V_0$. This should assure correct hand-off of the sheet from the upstream path to the paper registration device.

In this regard, agile registration commences shortly after the paper arrival as detected by sensors LEA and LEB. The sensors report the time-of-arrival t0 and the process position x0 and angle β0 of the sheet. The side edge, or lateral, sensor reports the lateral position y0. In many cases, the lead-edge-center or lead-edge-side is considered the point that is being registered. Simple geometric calculation will yield values for the initial conditions of the registration point from sensor measurements.

Typically, delivery strategies calculate velocity profiles $V_A(t)$ and $V_B(t)$ to deliver the sheet 14 from these initial conditions to an end condition. The velocity profiles $V_A(t)$ and $V_B(t)$ must be calculated to deliver the sheet to position xf, yf, βf at a time tf with a velocity vf. As noted above, the velocity vf usually matches the velocity of the downstream device. However, in actual implementation, there are many factors that detract from these expectations.

In this regard, agile registration processes using polynomial profiles have been used. However, while polynomial agile registration typically exhibits accurate registration results, a large tail wag is generated. Triangular profiles have also been used. These profiles typically result in a small tail wag, but have less accurate results. Use of trapezoidal profiles has advantages, but typically leads to unpredictable nip forces.

It is desired that velocity profiles be calculated more accurately than is presently known to obtain precise delivery of sheets at various points in the paper path to achieve desired paper registration.

INCORPORATION BY REFERENCE

U.S. Pat. No. 5,678,159 is hereby incorporated by reference.

BRIEF DESCRIPTION

In one aspect of the presently described embodiments, the method comprises determining a lateral position of a sheet entering the nips of a paper path, determining a skew of the sheet as it enters the nips of the paper path, establishing a registration time, establishing a nominal velocity of the sheet on the paper path, determining an amplitude of a process direction correction velocity, computing a first value based on the lateral position, the skew, the registration time, the average velocity and the amplitude of the process direction correction velocity, determining a second value based on the first value, determining a peak of the lateral correction profile based on the second value, determining a velocity profile based on the peak, and, controlling the document processing device based on the profile.

In another aspect of the presently described embodiments, determining the lateral position of the sheet is based on detecting by a lateral sensor.

In another aspect of the presently described embodiments, determining the skew is based on detecting of the sheet by leading edge sensors.

In another aspect of the presently described embodiments, establishing the registration time is based on a target delivery time.

In another aspect of the presently described embodiments, establishing the registration time is based on a difference between a first time when the sheet engages leading edge sensors and a second time when the sheet should reach a target.

In another aspect of the presently described embodiments, determining the nominal velocity of the sheet comprises calculating an average velocity of the sheet.

In another aspect of the presently described embodiments, determining the amplitude of a process direction correction velocity is accomplished in closed form.

In another aspect of the presently described embodiments, the first value is computed using y=y+C*skw*Tee*(Vel Nom+VPro/2)/2.

In another aspect of the presently described embodiments, the second value is computed by dividing the first value by $Tee^{1.5}$.

In another aspect of the presently described embodiments, the controlling comprises applying the velocity profile to the drive wheels of the document processing device.

In another aspect of the presently described embodiments, suitable means are provided to implement the method.

DETAILED DESCRIPTION

The velocity registration problem can be transposed. That is, rather than prescribing the motion of the sheet, one can prescribe the motion of the center of the wheels on the sheet.

Figure 1:
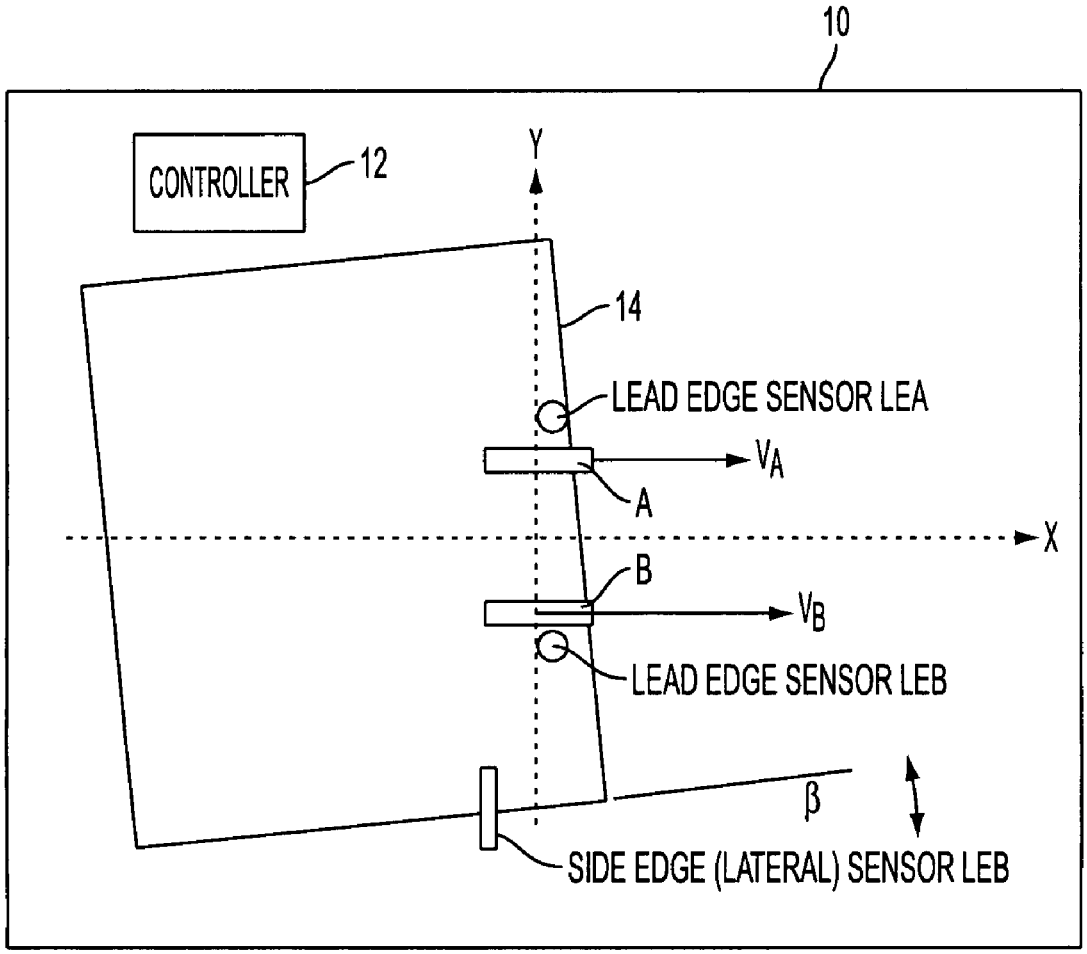
FIG. 1 is a graphic representation of an image rendering device into which the presently described embodiments may be incorporated.
Figure 2:
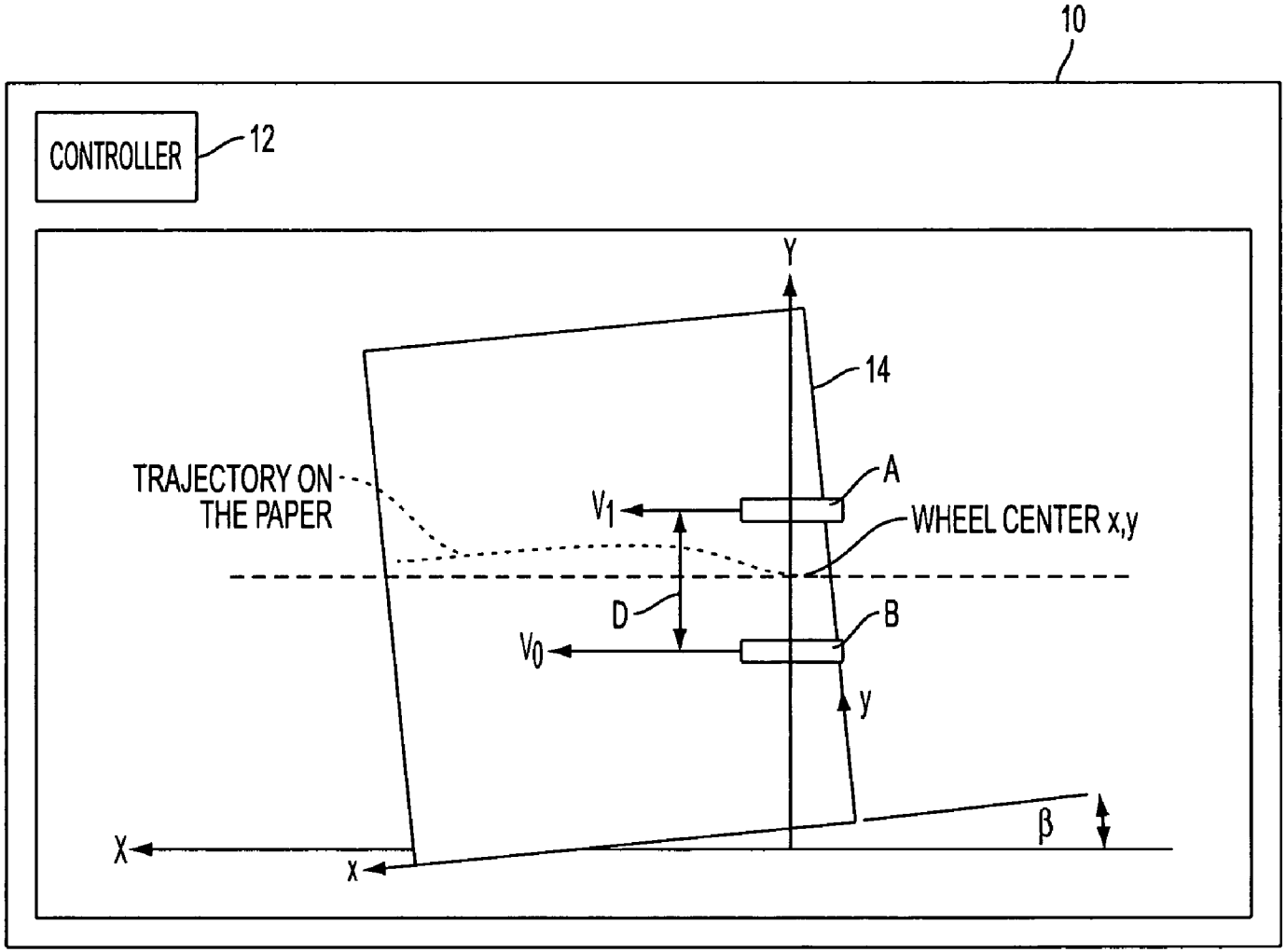
FIG. 2 is another graphic illustration of an image rendering device into which the presently described embodiments may be incorporated.

This approach is illustrated in the FIG. 2. It should be understood that the system 10 of FIG. 2 is substantially the same as that of FIG. 1. For ease of viewing, the sensors are not shown in FIG. 2, but are understood to be incorporated in the system.

The equations that describe the path are as follows:

$$\frac{ds}{dt} = \frac{V_0 + V_1}{2} = V_{AVG}$$

$$\frac{d\beta}{dt} = \frac{V_0 - V_1}{D}$$

$$\frac{dx}{dt} = V_{AVG}\cos\beta$$

$$\frac{dy}{dt} = V_{AVG}\sin\beta$$

s=progress along the path of wheel center

β=angle of the path of wheel center

D=distance between the wheels x=coordinate of the path of wheel center y=coordinate of the path of wheel center These equations can be integrated in closed form only for small values of the angle β.

The presently described embodiments are directed to a method and system for improving sheet registration in a document processing device. The presently described embodiments implement a technique the produces accurate results with merely a small tail wag. To do so, the method ultimately establishes or determines a variety of parameters (e.g. lateral position of a sheet, skew, registration time, nominal sheet velocity, and correction velocity). These parameters are then used by the system to calculate a lateral velocity profile. In this regard, the calculated velocity profiles (such as that determined using the method of FIG. 8) are applied to the wheels or nips, in the paper path. Thus, the wheels can be controlled and will allow for improved sheet registration in the document processing device.

Figure 3:
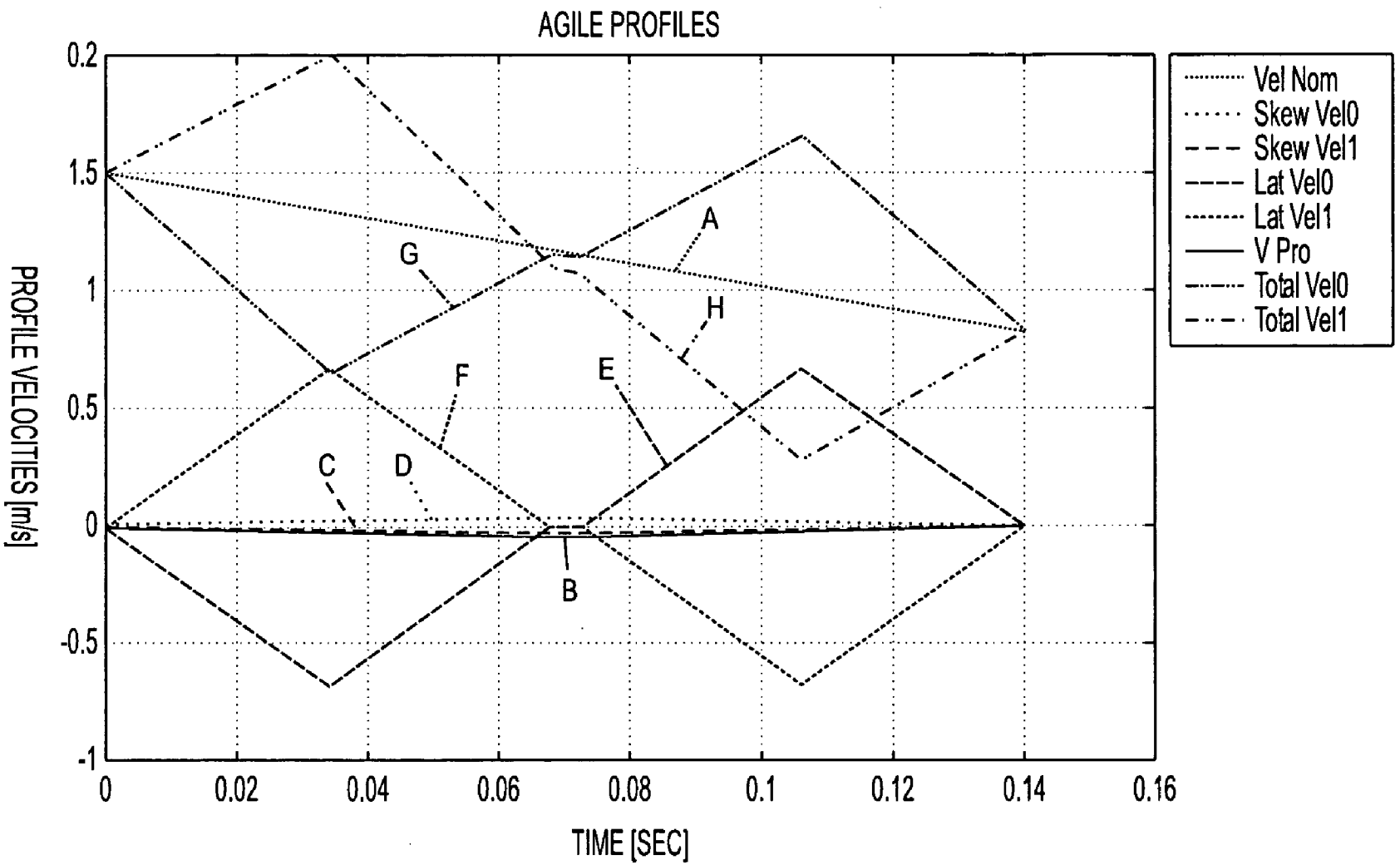
FIG. 3 illustrates velocity profiles utilized in connection with the presently described embodiments.

With reference to FIG. 3, examples of profiles used in a method of the presently described embodiments are shown. From these profiles, and the processes described in connection with FIGS. 4-6, sufficient information regarding the velocity profile of the paper path can be determined and used in connection with a method, such as that described in FIG. 8. It should be understood that the graph generated as a result of this analysis in FIG. 6, is used in the method of FIG. 8 to determine a corrected velocity profile for the system. This, of course, improves the sheet registration process, as noted above.

The profile of FIG. 3 comprises the following elements:

1. A nominal velocity Vel Nom (line A)
2. A process direction correction velocity (line B) with amplitude, VPro
3. A skew correction velocity (lines C and D) for inboard and outboard wheels, Skew Vel0 and Skew Vel1;
4. A lateral correction velocity (lines E and F) for inboard and outboard wheels, Lat Vel0 and Lat Vel1.

The sum of these elements result in the velocities of the inboard and outboard wheels (lines G and H), Total Vel0 and Total Vel1. Note that the amplitude of the skew correction velocity (lines C and D) and process correction velocity (line B) can be calculated in closed form. This is not true for the lateral profile. Also note that the acceleration of the lateral profile is by far the largest. It is the dominant contributor to the inertial forces that the sheet exhibit onto the wheels. Hence, this lateral acceleration is selected to be a constant and its value is set by maximum sheet force requirements.

A solution method for agile profile generation is presented below.

1. The lateral acceleration 'acc' is assumed constant.
2. Vary the process direction registration time 'Tee' from the nominal (160 ms in this example) by [−20, 0, +20] ms.
3. Calculate amplitude of process direction correction (line B), VPro.
4. Calculate skew profile amplitude (lines C and/or D) for a range of input skew 'skw'=[−25, 0, +25] mrad.
5. Impose a range of lateral correction amplitudes (lines E and/or F) from −acc*Tee/4 to +accTee/4 in increments of accTee/128. Note that accTee/4 is the maximum amplitude that can be obtained.

The lateral corrections are then calculated for the above variation from the equations noted above. The results are shown in FIG. 4.

Figure 4:
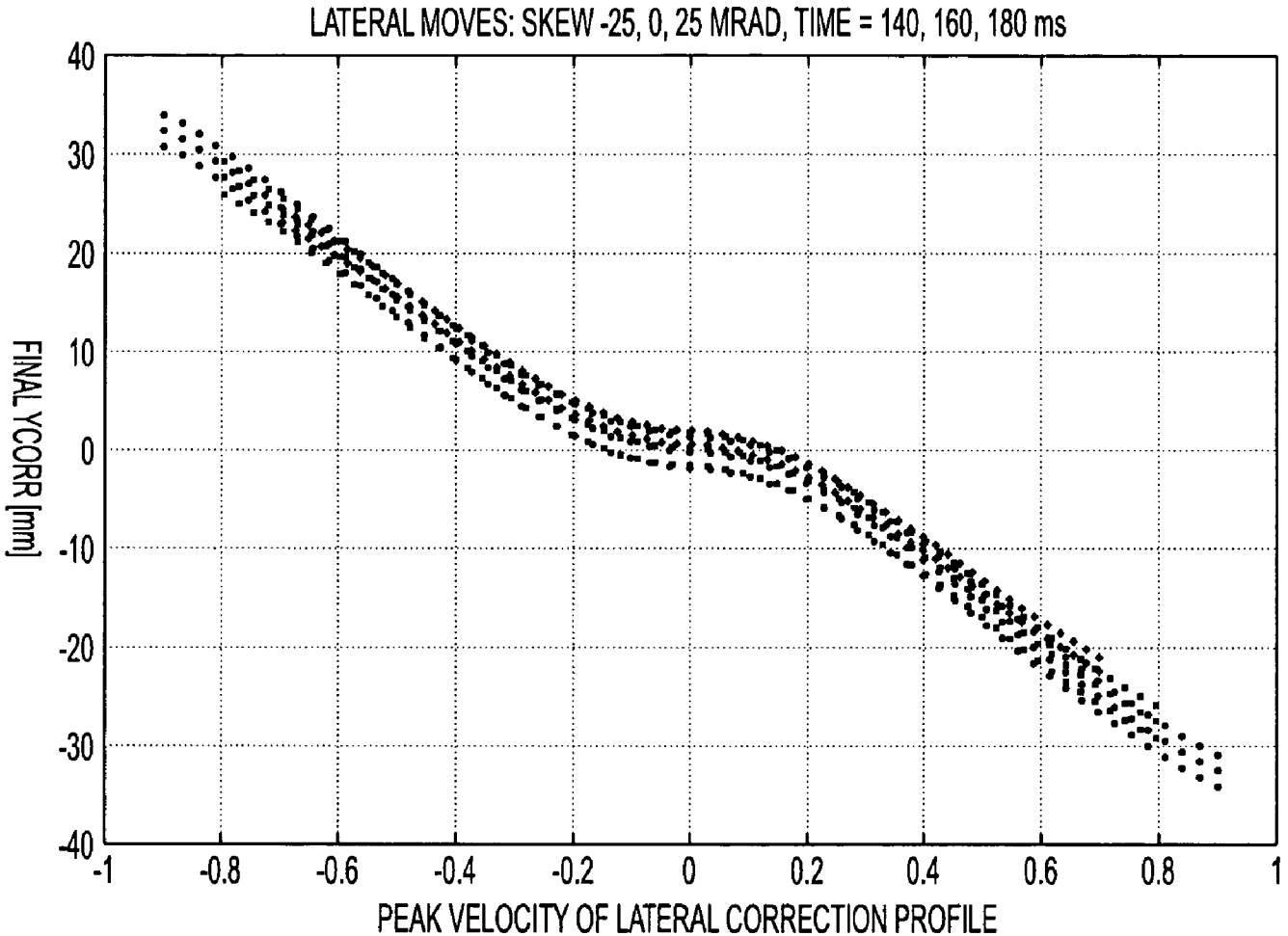
FIG. 4 is a graph illustrating peak velocities.

The different shapes of the data points correspond to different registration times (diamonds=140 ms, squares=160 ms and circles=180 ms) in FIGS. 4-7. The clusters of data points in three apparent lines for each color correspond to different skew (skw) values (−25, 0, +25 mrad). FIG. 4 shows how the amount of lateral correction varies with the peak of the lateral correction triangular profile.

Figure 5:
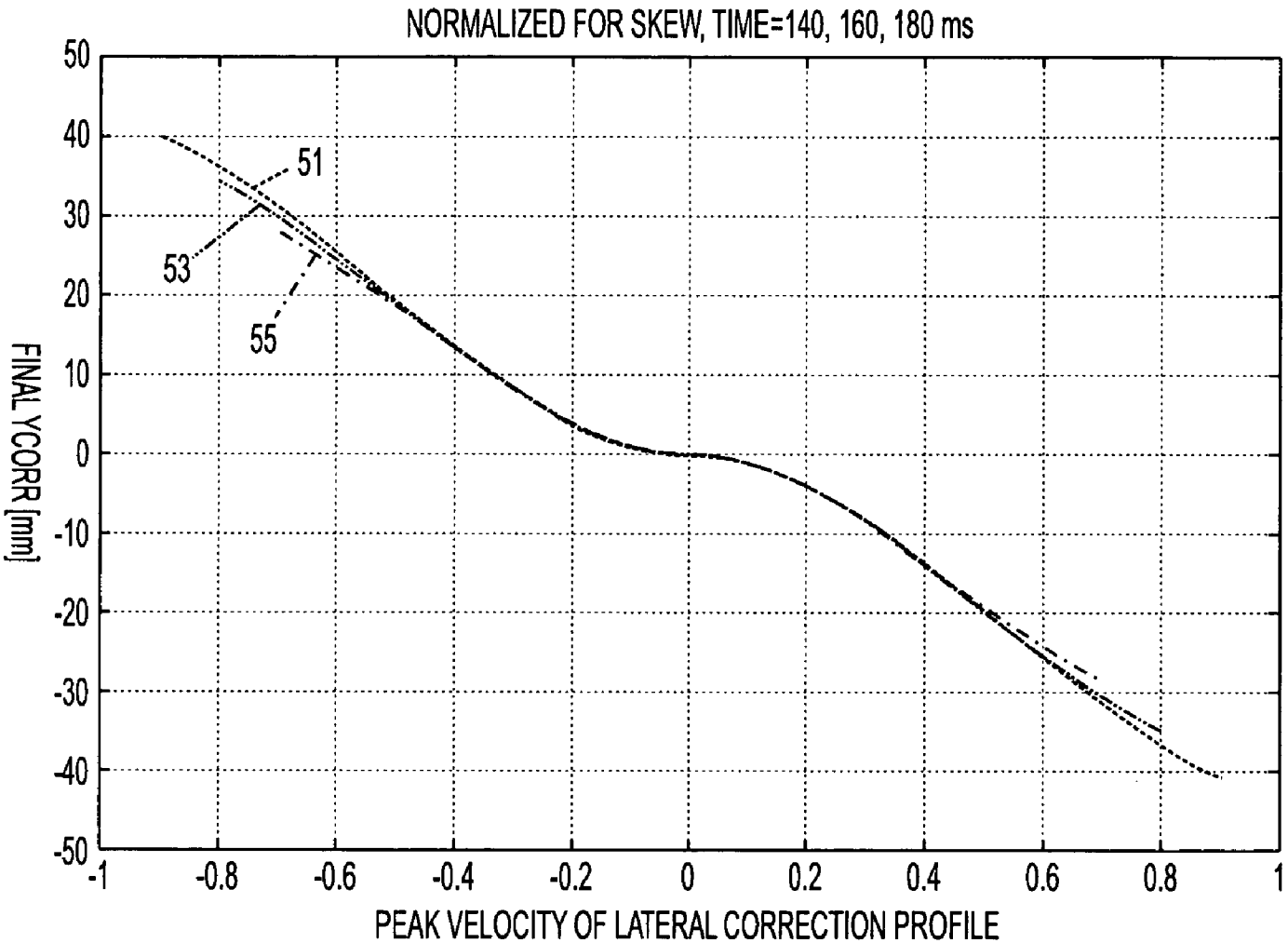
FIG. 5 is a graph illustrating normalized peak velocities.
Figure 6:
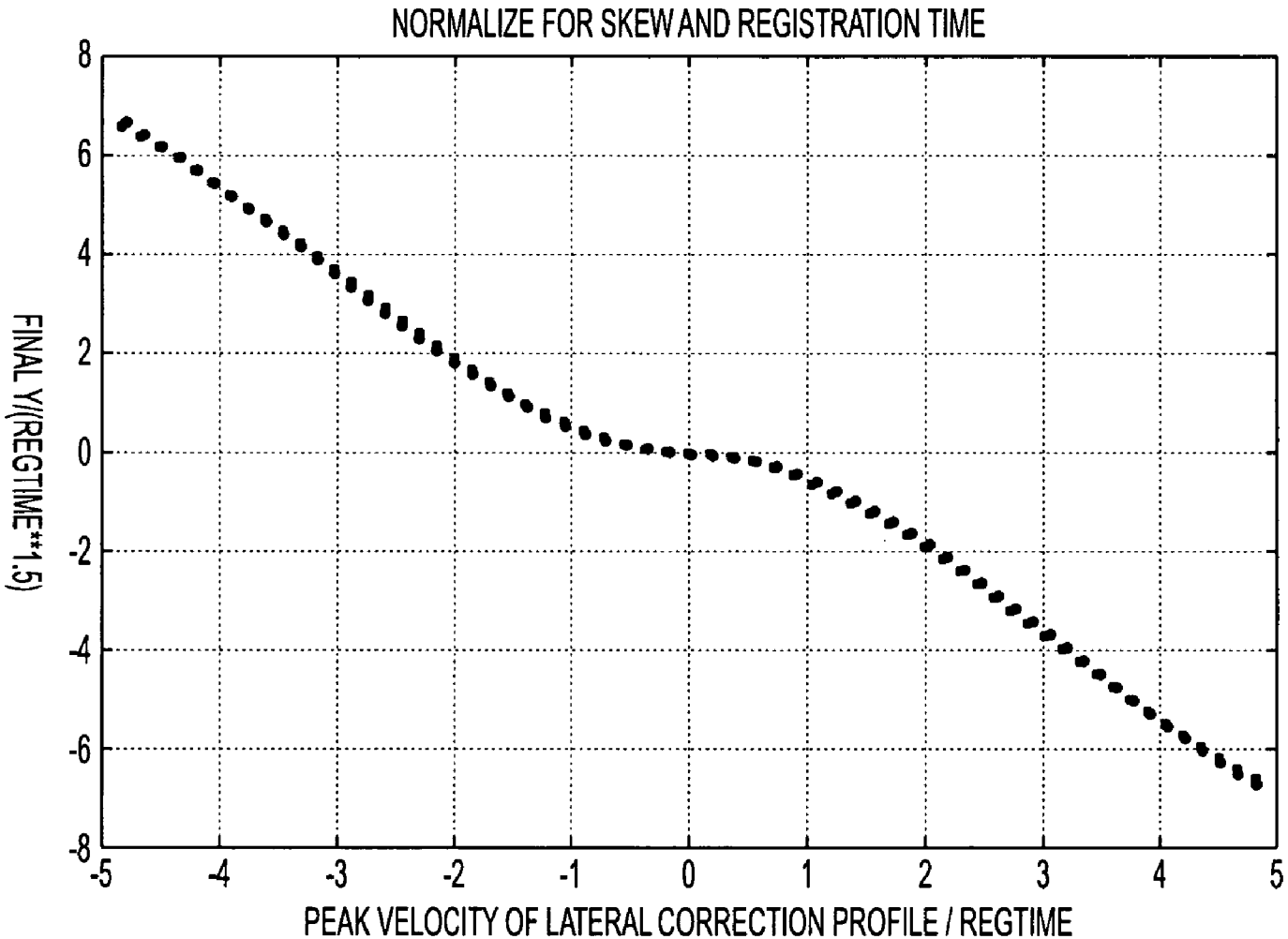
FIG. 6 is a graph illustrating peak velocities normalized for registration time.

Next, with reference to FIG. 5, the following operation is performed on all the y-values (Vel Nom is the nominal velocity, C is a factor found by trial and error to give the best fit, $y_{new}$ is a new lateral position, $y_{old}$ is an old or current lateral position).

$$y_{new}=y_{old}-C*\text{skw}*\text{Tee}*(\text{Vel Nom}+V\text{Pro}/2)/2$$

As shown in FIG. 5, this makes all the plots for the different skews overlap. The dashed line 51 corresponds to a 180 ms registration time. The dash-double dot line 53 corresponds to 160 ms registration time, And, the dash-dot line 55 corresponds to a 140 ms.

Next, with reference to FIG. 6, the peak of the lateral correction profile is normalized by (x-axis in the figure above) diving it by the registration time 'Tee'. Also, the y-values are divided by $\text{Tee}^{1.5}$. The result is shown in FIG. 6.

Note that the normalization process makes data points almost coincide. For convenience, this is illustrated as large dots that coincide with no apparent distinction. If the y-values are averaged at different x-locations, then there is a single curve that is useful.

It should be understood that the methods and techniques of the presently described embodiments may be implemented using a variety of software routines and/or hardware configurations. For example, software routines reflecting, for example, the method set forth in FIG. 8 or others according to the presently described embodiments (such as methods described in connection with FIGS. 2-6), may reside in and be implemented by a controller, such as controller 12 of FIGS. 1 and 2. Of course, the software may also reside on other elements in a printing environment or be distributed among suitable elements in such a printing environment.

Figure 8:
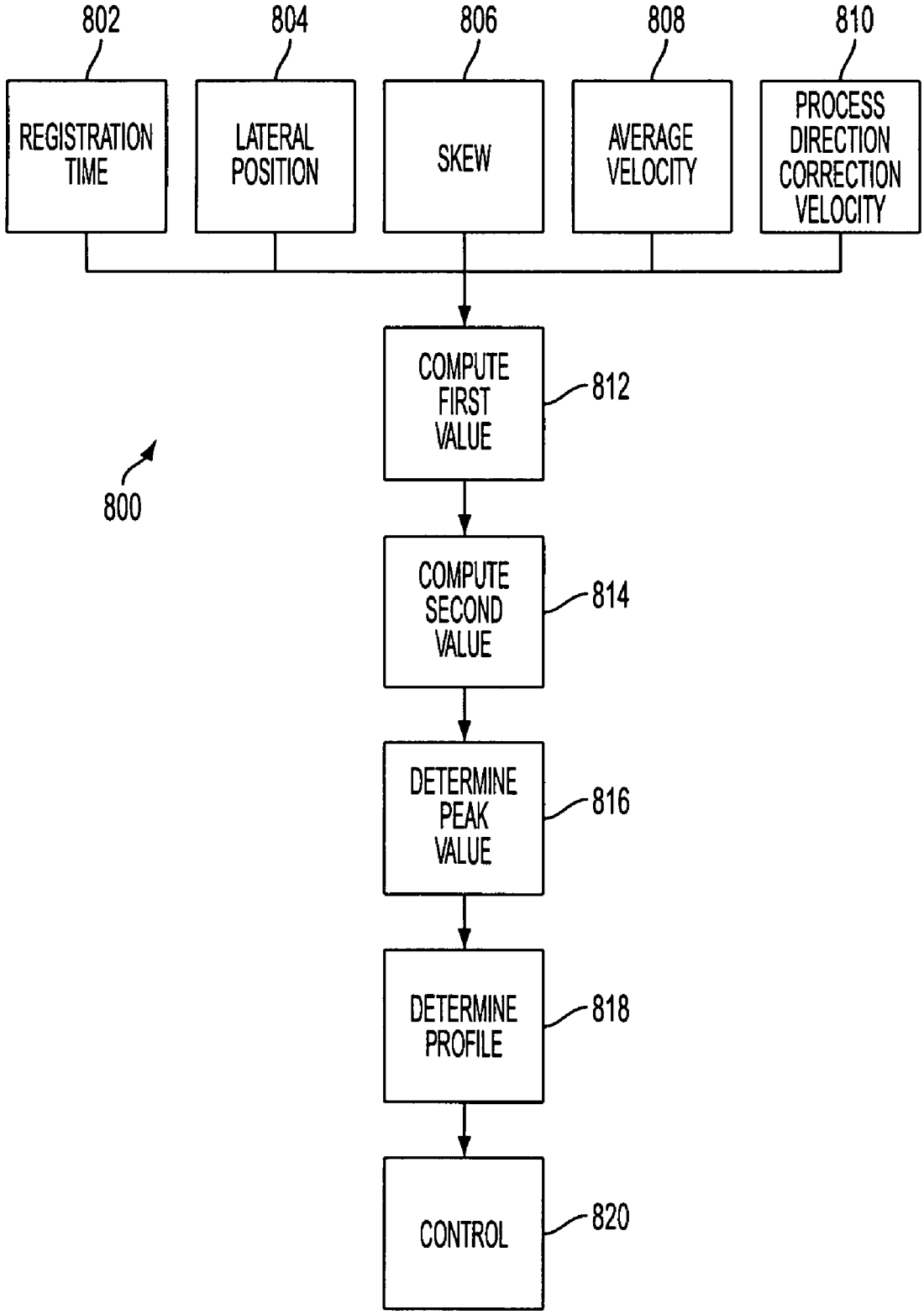
FIG. 8 is a flow chart illustrating a method according to the presently described embodiments.

With reference now to FIG. 8, a procedure or method 800 to obtain the amplitude of the lateral correction profile for a given set of input conditions is as follows:

Initially, a variety of input parameters are provided to the controller. For example, input conditions of lateral position of the sheet y (lat) (at 804), a skew of the sheet (skw) (at 806), a desired registration time, Tee (at 802), a nominal velocity, Vel Nom (at 808) and a process correction velocity (at 810).

It should be understood that the lateral position y is determined through implementation of the side edge or lateral sensor illustrated in FIG. 1. The output of this sensor provides a lateral position of the sheet 14 as it progresses down the paper path. In one form, the lateral position is measured at a point in time when the wheels or nips of the paper path obtain control of the sheet.

The measured skew (skw) is computed by determining the difference in times that the leading edge sensors detect the sheet 14. So, sensors LEA and LEB provide the time at which the sheet 14 is detected by the sensors. The difference in time detected by these sensors is then multiplied by the sum $(V_A+V_B)/2$, and then divided by the spacing between the sensors LEA and LEB. This provides a measure that is in radians, or an angle of the skew.

The registration time, Tee, is established to be the target delivery time from the point at which the leading edge sensors detect the sheet 14 to the arrival time (i.e., delivery time) to the appropriate downstream device in the paper path. The nominal velocity, Vel Nom, is an average of the speed of travel of the sheet on the paper path. The process correction velocity, VPro, is an amplitude of process correction velocity.

Also, a constant, C, is used in the equation above and below. This constant is determined through experimentation and varies by families of machines. The constant is dependent upon the geometry of the system, wheel spacing, . . . etc.

Referring back to FIG. 8, these input parameters are then used to compute a first value: $y_{new}=y_{old}+C*skw*Tee*(Vel\ Nom+VPro/2)/2$ (at 812) where skw is measured. $y_{new}$ is a new lateral position and $y_{old}$ is an old or current lateral position. Next, a second value is computed: $y/(Tee^{1.5})$ (at 814). Using FIG. 6, a corresponding value Vstar on the x-axis is determined by linear interpolation. A peak of the lateral correction profile is then calculated by multiplying by Tee (at 816).

Thus, the lateral profile can then be determined (at 818). Note that skew and process correction velocities were calculated in closed form. Since the acceleration is held constant, this profile can be constructed.

Figure 7:
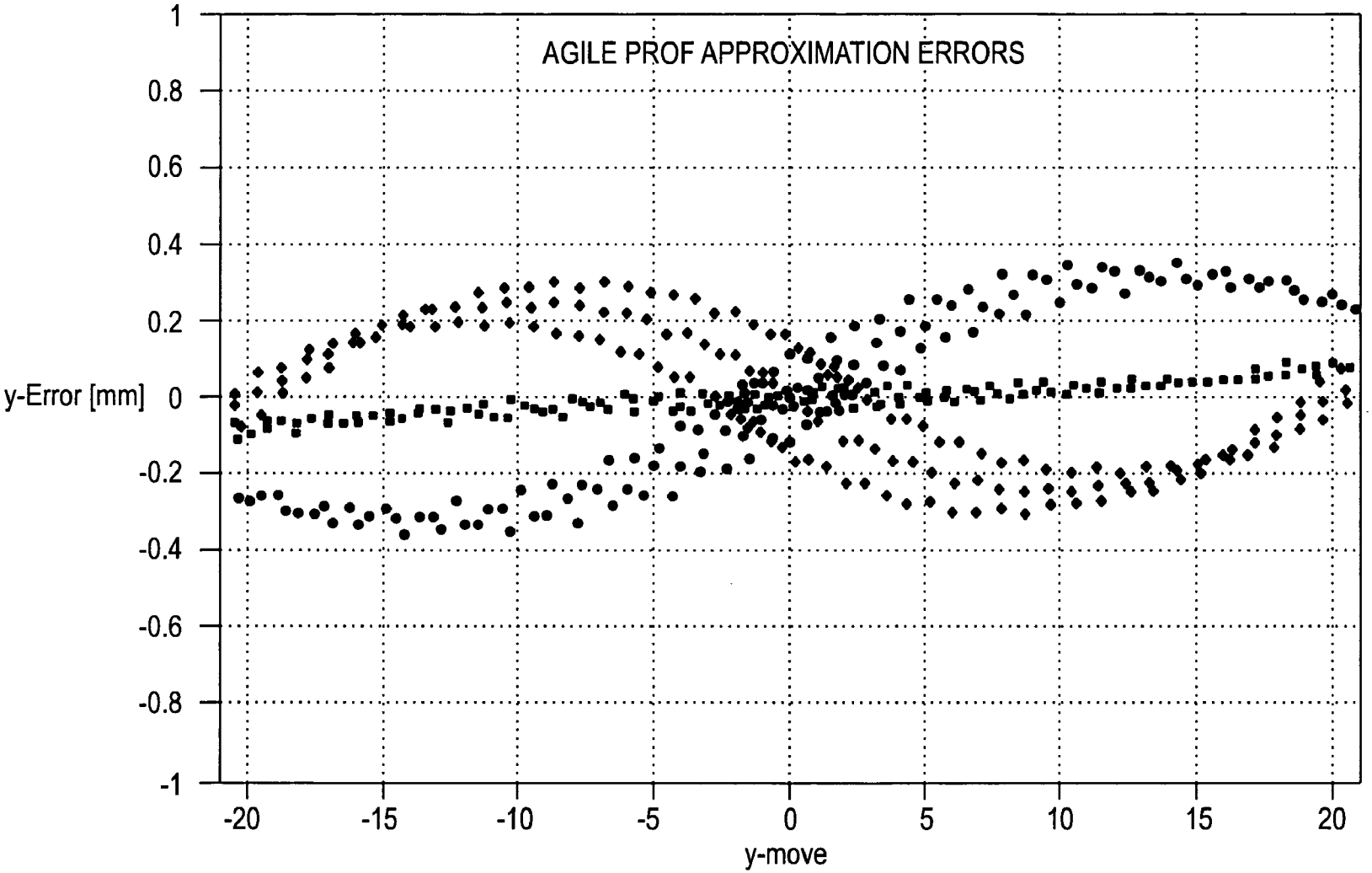
FIG. 7 is a graph showing approximation errors.

With reference now to FIG. 7, error analysis was performed. The results are shown in the curve. The dots represent different values of skew and registration time. The diamonds represent a registration time of 140 ms. The squares represent a registration time of 160 ms. And, the circles represent a registration time of 180 ms. It should be appreciated that the error is less than 350 um for lateral moves up to 10 mm.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A sheet registration method useful in a document processing device, the method comprising using a controller for:

determining a lateral position of a sheet entering nips of a paper path;

determining a skew of the sheet as the sheet enters the nips of the paper path;

establishing a registration time;

establishing a nominal velocity of the sheet on the paper path;

determining an amplitude of a process direction correction velocity;

computing a first value based on the lateral position, the skew, the registration time, the nominal velocity, and the amplitude of the process direction correction velocity;

determining a second value based on the first value;

determining a peak based on the second value;

determining a velocity profile based on the peak; and, controlling the document processing device based on the velocity profile.

2. The method as set forth in claim 1 wherein determining the lateral position of the sheet is based on detecting by a lateral sensor.

3. The method as set forth in claim 1 wherein determining the skew is based on detecting of the sheet by leading edge sensors.

4. The method as set forth in claim 1 wherein establishing the registration time is based on a target delivery time.

5. The method as set forth in claim 1 wherein establishing the registration time is based on a difference between a first time when the sheet engages leading edge sensors and a second time when the sheet should reach a target.

6. The method as set forth in claim 1 wherein establishing the nominal velocity of the sheet comprises calculating an average velocity of the sheet.

7. The method as set forth in claim 1 wherein determining the amplitude of the process direction correction velocity is accomplished in closed form.

8. The method as set forth in claim 1 wherein the first value is computed using $y_{new}=y_{old}+C*skw*Tee*(Vel\ Nom+VPro/2)/2$ where $y_{new}$ is a new lateral position, $y_{old}$ is an old or current lateral position, C is a constant, skw is the skew, Tee is the registration time, Vel Nom is the nominal velocity, and VPro is the amplitude of the process direction correction velocity.

9. The method as set forth in claim 8 wherein the second value is computed by dividing the first value by $Tee^{1.5}$, where Tee is the registration time.

10. The method as set forth in claim 1 wherein the controlling comprises applying the velocity profile to drive wheels of the document processing device.

11. A sheet registration system useful in a document processing device having wheels with nips along a paper path, the system comprising:

means for determining a lateral position of a sheet entering the nips on the paper path;

means for determining a skew of the sheet as the sheet enters the nips on the paper path;

means for establishing a registration time;

means for establishing a nominal velocity of the sheet on the paper path;

means for determining an amplitude of a process direction correction velocity;

means for computing a first value based on the lateral position, the skew, the registration time, the average velocity, and the amplitude of the process direction correction velocity;

means for determining a second value based on the first value;

means for determining a peak of a lateral correction profile based on the second value;

means for determining a velocity profile based on the peak; and, means for controlling the document processing device based on the velocity profile.

12. The system as set forth in claim 11 wherein the means for determining the lateral position of the sheet comprises a lateral sensor.

13. The system as set forth in claim 11 wherein the means for determining the skew comprises leading edge sensors.

14. The system as set forth in claim 11 wherein means for determining the registration time is based on a target delivery time.

15. The system as set forth in claim 11 wherein the means for determining of the registration time is based on a difference between a first time when the sheet engages leading edge sensors and a second time when the sheet should reach a target.

16. The system as set forth in claim 11 wherein means for determining the nominal velocity of the sheet comprises calculating an average velocity of the sheet.

17. The system as set forth in claim 11 wherein means for determining the amplitude of the process direction correction velocity is accomplished in closed form.

18. The system as set forth in claim 11 wherein the first value is computed using $y_{new}=y_{old}+C*skw*Tee*(Vel\ Nom+VPro/2)/2$ where $y_{new}$ is a new lateral position, $y_{old}$ is an old or current lateral position, C is a constant, skw is the skew, Tee is the registration time, Vel Nom is the nominal velocity, and VPro is the amplitude of the process direction correction velocity.

19. The system as set forth in claim 18 wherein the second value is computed by dividing the first value by $Tee^{1.5}$, where Tee is the registration time.

20. The system as set forth in claim 11 wherein the means for controlling comprises means for applying the velocity profile to the wheels of the document processing device.

* * * * *